US008387544B1

(12) United States Patent
Lee

(10) Patent No.: US 8,387,544 B1
(45) Date of Patent: Mar. 5, 2013

(54) METHOD AND APPARATUS FOR ORNAMENTAL TABLE TOP

(75) Inventor: Clifton Shao-ming Lee, Hillsborough, CA (US)

(73) Assignee: Numark Industries Company Limited, Hong Hom (CN)

( * ) Notice: Subject to any disclaimer, the term of this patent is extended or adjusted under 35 U.S.C. 154(b) by 0 days.

(21) Appl. No.: 13/199,102

(22) Filed: Aug. 19, 2011

(51) Int. Cl.
*A47B 13/00* (2006.01)

(52) U.S. Cl. ..... 108/161; 108/90

(58) Field of Classification Search ..... 108/90, 108/161
See application file for complete search history.

(56) References Cited

U.S. PATENT DOCUMENTS

| | | | | | |
|---|---|---|---|---|---|
| 749,799 | A * | 1/1904 | Mitchum | 108/161 |
| 1,196,698 | A * | 8/1916 | Keller | 108/161 |
| 1,738,429 | A * | 12/1929 | Heyman | 108/186 |
| 3,001,843 | A * | 9/1961 | Davis | 108/62 |
| 3,062,604 | A * | 11/1962 | Hodgen | 428/49 |
| 3,150,032 | A * | 9/1964 | Rubenstein | 428/313.7 |
| 3,164,110 | A * | 1/1965 | Bofinger | 108/161 |
| 3,212,952 | A * | 10/1965 | Turner | 428/38 |
| 3,421,679 | A * | 1/1969 | Goldman | 206/523 |
| 3,554,140 | A * | 1/1971 | Homesberger | 108/90 |
| 3,610,175 | A * | 10/1971 | Wilton et al. | 108/161 |
| 3,688,707 | A * | 9/1972 | White | 108/159 |
| 4,192,083 | A * | 3/1980 | Rebbeck | 434/72 |
| 4,656,953 | A * | 4/1987 | Miller, Jr. | 108/153.1 |
| 4,761,931 | A * | 8/1988 | Schrunk | 52/782.2 |
| D362,769 | S * | 10/1995 | Paus | D6/477 |
| 6,659,023 | B2 * | 12/2003 | Saltzman et al. | 108/161 |
| 6,915,749 | B2 * | 7/2005 | Chang | 108/161 |
| 7,036,439 | B2 * | 5/2006 | Poo | 108/161 |
| 2006/0000393 | A1 * | 1/2006 | Ka'ahumanu | 108/25 |
| 2007/0227416 | A1 * | 10/2007 | Wang | 108/161 |
| 2010/0175593 | A1 * | 7/2010 | Davis | 108/25 |
| 2011/0316313 | A1 * | 12/2011 | Gasser | 297/188.01 |

FOREIGN PATENT DOCUMENTS

FR 2637474 A3 * 4/1990

* cited by examiner

*Primary Examiner* — Jose V Chen
(74) *Attorney, Agent, or Firm* — Daniel Hopen

(57) ABSTRACT

Some embodiments of the present disclosure provide a method and apparatus for an ornamental table with an ornamental table top design. The ornamental table simplifies the manufacture of ornamental table top designs and affords speedy ornamental design variations. The ornamental table comprises a table top frame, and a set of table legs coupled to the table top frame wherein the table top frame includes a plurality of support bars attached to the table top frame interconnected to produce a grid-like pattern. A plurality of large tiles is set on top of the grid-like pattern to produce a first ornamental design. A channel is coupled to the support bars surrounding a perimeter of the grid-like pattern and a plurality of small tiles is set within the channel to produce a second ornamental design.

17 Claims, 3 Drawing Sheets

METHOD AND APPARATUS FOR ORNAMENTAL TABLE TOP

BACKGROUND

1. Technical Field

This disclosure generally relates to table tops, and more particularly to an ornamental patio table top with multiple design options.

2. Related Art

Conventional outdoor furniture of the type intended for use on decks and patios are very popular. Manufacturers of outdoor patio furniture are constantly called upon to offer new innovative designs that provide practical, comfortable products to the consumer. Manufacturers on one hand are interested in offering innovative and fresh designs, but are also interested in reducing manufacturing cost by simplifying and reducing the time to manufacture the outdoor patio furniture.

As the outdoor patio furniture industry has developed, a popular feature for patio tables is to provide a fresh table top design. However, providing a table top design can add substantial cost to the patio table. What is needed is an ornamental table top design that is simple to manufacture and flexible to enable ample design options for the consumer.

SUMMARY OF INVENTION

A method and apparatus for a novel ornamental table with an ornamental table top design are disclosed which overcome manufacturing challenges and is flexible to easily implement different ornamental designs. The novel ornamental table with an ornamental table top simplifies manufacturing and adds flexibility to alter the ornamental design as customer preference for colors and ornamental styles changes. Accordingly, an ornamental table comprises a table top frame, a set of table legs coupled to the table top frame, wherein the table top frame includes, a plurality of support bars configured to produce a grid-like pattern, a plurality of large tiles configured to set on top of the grid-like pattern to produce a first ornamental design, a channel coupled to the support bars surrounding a perimeter of the grid-like pattern, a plurality of small tiles configured to set within the channel to produce a second ornamental design, and a rim coupled to the channel surrounding the perimeter of the channel.

In accordance to another embodiment of the present invention, the large tiles are set on top of the plurality of support bars. The plurality of support bars defines a plurality of polygons and the large tiles are sized slightly smaller than the polygons.

In accordance to another embodiment of the present invention, caulking fills the space between the large tiles to produce a flat table top surface.

In accordance to another aspect of the present invention, the small tiles include a mosaic decoration, which some consumers may prefer over tiles or slats.

DETAILED DESCRIPTION

Figure 1:
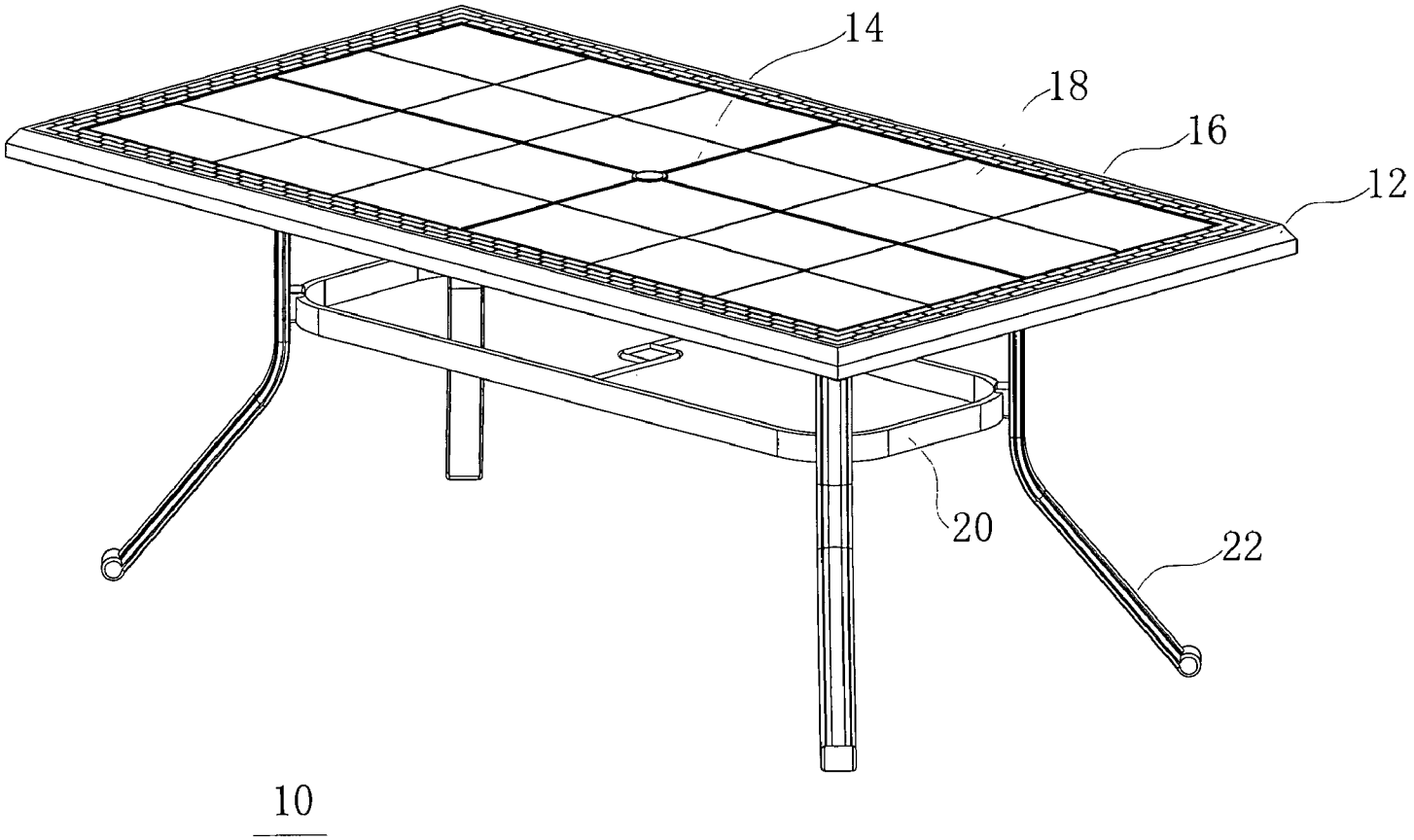
FIG. 1 illustrates an ornamental table with an ornamental table top design in accordance with an embodiment of the present invention.

FIG. 1 illustrates an ornamental table with an ornamental table top design 10 in accordance with an embodiment of the present invention. The ornamental table 10 includes a table rim 12, support bars 14, a first ornamental design 16, a second ornamental design 18, a center ring 20, and legs 22. The first ornamental design 16 may consist of smaller tiles, slates, glass or mosaic design. Similarly, the second ornamental design 18 may consist of large tiles, slats, mosaics or glass that fits on top the support bars 14. There is a narrow channel adjacent the table rim 12 that provides placement for the first ornamental design 16. A grid-like pattern that is formed by the support bars 14 provides a platform for setting the second ornamental design 18.

Figure 2A:
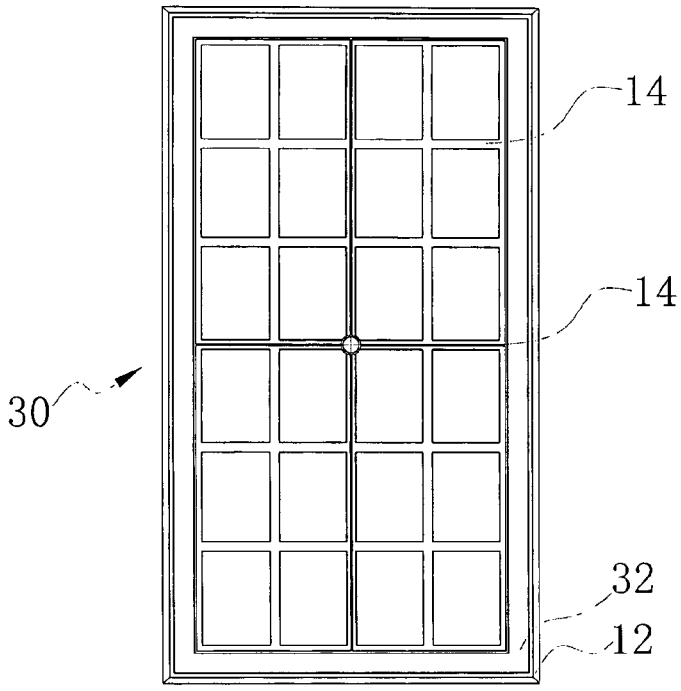
FIG. 2A illustrates a table top frame for the ornamental table with support bars and the channel in accordance with an embodiment of the present invention.

FIG. 2A illustrates a table top frame 30 for the ornamental table with an ornamental table top design 10. The table top frame 30 includes a rim 12 surrounding a channel 32 that is configured around the perimeter of the table top frame 30. The support bars 14 define a grid-like pattern for which ornamental tiles, slats, etc. when placed onto the table top frame 30 are supported by the support bars 14. The smaller tiles, slats, etc. are placed into the channel 32.

Figure 2B:
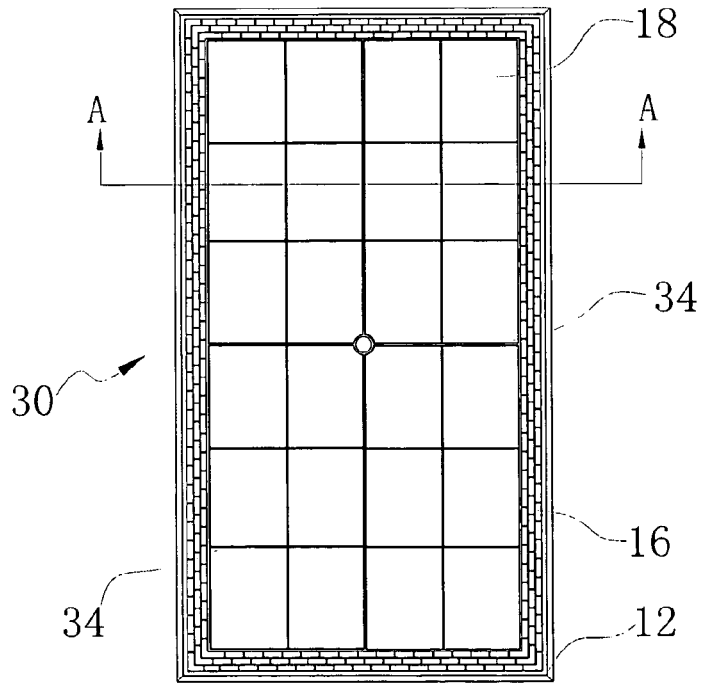
FIG. 2B illustrates a table top for the ornamental table with large tiles and small tiles set onto the table top in accordance with an embodiment of the present invention.

FIG. 2B illustrates, the table top frame 30 of FIG. 2A with the first ornamental design 16 and the second ornamental design 18 set onto the table top frame 30. In preparing the table top frame in accordance to an embodiment of the present invention after the frame is welded together with the rim 12 and table support bars 14, the entire table top frame 30 is cleaned and processed with powder coating in accordance to known techniques. The small tiles 16 are positioned and adhered to the channel 32 and, the large tiles 18 are positioned and adhered to the support bars 14. It is appreciated that the large tiles 18 are approximately the same size as the boundaries defined by the support bars 14 so as to provide support for the large tiles 18, although in another embodiment, tiles larger than the boundaries may also be used depending on the ornamental design. The large tiles 18 are slightly smaller than the boundaries defined by the support bars 14 to enable caulking to fill the gaps between the tiles. Similarly, caulking 34 is applied to the small tile 16. Accordingly, once the tiles are secured to the table top frame 30, chalking compound 34 is used to fill the gaps between the adjacent tiles to make the surface of the table top frame smooth and flat. Depending on the ornamental design, different caulking compounds 34 can be used to change the finished appearance of the ornamental table.

Building the table top frame 30 using a plurality of support bars instead of flat surface greatly simplifies manufacturing while eliminating wasted material and the overall weight of the finished table. Reducing the use of material can greatly lower the cost of the product to the consumer. Often time, the table tops are made of aluminum to reduce weight and provide a better finished product compared to steel. However, aluminum is more expensive so reducing material use is a major advantage in the table top design of the present invention.

Figure 3:
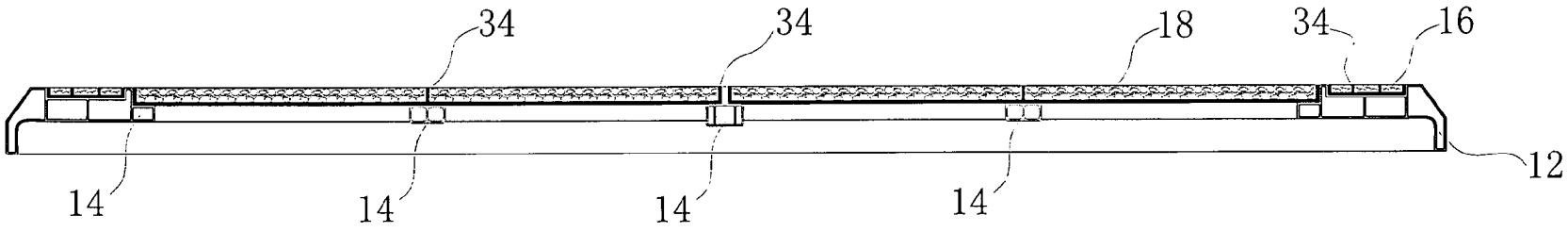
FIG. 3 illustrates an exemplary cut-out view of the table top frame taken along line A-A of FIG. 2B.

FIG. 3 illustrates a cross-section of the table top frame 30 of FIG. 2B taken along line A-A. Support bars 14 lies below the large tiles 18 to provide support for the large tiles 18. Caulking compound 34 is used to fill the gaps between the adjacent tiles. The small tiles 16 fill the channel adjacent to the rim 12. Again, caulking compound 34 is used to fill the gaps between the adjacent tiles. It is appreciated that the depth or thickness of the channel for the small tiles 16 is less than the depth or thickness for the large tiles 18. Moreover, the small tiles 16 are thinner than the large tiles 18. Large tiles 18 are thicker to accommodate more weight bearing capability compared with the smaller tiles surrounding the edge of the table top.

The present novel ornamental table is susceptible to minor variations and modifications that may be introduced without departing from the inventive concept. For example, there may be many different variations of tiles, slates, or glass that can be used. Grout or mortar can be used to adhere or fill the gaps between the tiles. Larger tiles can be used instead of the tiles that are sized according to the boundaries defined by the support bars. Mosaics can be used instead tiles to fill the channel adjacent to the rim 12.

It is further appreciated that designation of furniture as fitting into categories such as chairs, lounges, and other separate and distinct varieties may be inadequate. For example, patio furniture as opposed to furniture designs may show no clear delineation separating the two categories. Accordingly, a patio table design may be used as a table for indoor use.

The foregoing descriptions of embodiments of the present invention have been presented only for purposes of illustration and description. They are not intended to be exhaustive or to limit the present invention to the forms disclosed. Accordingly, many modifications and variations will be apparent to practitioners skilled in the art. Moreover, the above disclosure is not intended to limit the present invention. The scope of the present invention is defined by the claims.

I claim:

1. An ornamental table comprising:

a table top frame having four frame members attached to form a parallelogram; and a set of table legs coupled to the table top frame;

wherein the table top frame includes:

a plurality of support bars attached to frame members of the table top frame and interconnected to produce a grid-like pattern;

a plurality of large tiles positioned to set on top of the grid-like pattern to produce a first ornamental design wherein the large tiles consist of varying colors or patterns;

a channel coupled to the support bars surrounding a perimeter of the grid-like pattern;

a plurality of small tiles positioned to set within the channel to produce a second ornamental design wherein the small tiles consist of varying colors or patterns; and a rim coupled to the channel surrounding the perimeter of the channel.

2. The ornamental table of claim 1 further comprising a center ring coupled to the set of table legs to provide structural support to the set of table legs.

3. The ornamental table of claim 1, wherein the large tiles set on top of the plurality of support bars.

4. The ornamental table of claim 3, wherein the plurality of support bars defines a plurality of polygons and the large tiles are sized slightly smaller than the plurality of polygons.

5. The ornamental table of claim 4, wherein the plurality of polygons are equal in size.

6. The ornamental table of claim 3, wherein caulking fills space between the large tiles to produce a flat table top surface.

7. The ornamental table of claim 1, wherein caulking fills space between the small tiles to produce a flat table top surface.

8. The ornamental table of claim 1, wherein the small tiles include a mosaic decoration.

9. The ornamental table of claim 3, wherein the large tiles are larger than the plurality of polygons defined by the support bars.

10. A method of manufacturing an ornamental table comprising the steps:

forming a table top frame having four frame members attached;

attaching a set of legs to the table top frame;

forming a grid-like pattern from interconnected support bars attached to the frame members of the table top frame;

adhering a plurality of large tiles approximately sized with the grid-like pattern so that a perimeter of each large tile is adhered onto the grid-like pattern of the support bars to produce a first ornamental design wherein the plurality of large tiles consists of varying colors or patterns;

forming a channel around a perimeter of the table top frame; and adhering a plurality of small tiles in the channel to produce a second ornamental design wherein the plurality of small tiles consist of varying colors or patterns; and forming a rim around the perimeter of the channel.

11. The method of claim 10 further comprising the step of attaching a center ring to the set of leg to provide additional support for the set of legs.

12. The method of claim 10 further comprising the step of caulking between the plurality of large tiles and the plurality of small tiles to provide a flat table top surface.

13. The method of claim 12, wherein the plurality of small tiles includes mosaic decoration.

14. An ornamental table comprising:

a support ring;

a set of four legs coupled to the support ring; and a table top frame having four frame members coupled to the four legs having interconnected support bars attached to the frame members of the table top frame forming a grid of polygons, a surrounding channel, and a rim wherein:

a plurality of large tiles slightly smaller in size to each polygon is set on top of the interconnected support bars defining the polygons to produce a first ornamental design wherein the plurality of large tiles consist of varying colors or patterns; and a plurality of small tiles is set inside the surrounding channel to produce a second ornamental design wherein the plurality of small tiles consist of varying colors or patterns and the surrounding channel lies between the plurality of large tiles set on top of the interconnected support bars and the rim.

15. The ornamental table of claim 14 further comprising caulking between the plurality of large tiles and the plurality of small tiles to produce a flat table top.

16. The ornamental table of claim 15, wherein the plurality of large tiles is thicker than the plurality of small tiles.

17. The ornamental table of claim 14, wherein the plurality of small tiles produce a mosaic.

* * * * *